United States Patent [19]

Brangenberg

[11] 3,951,421

[45] Apr. 20, 1976

[54] SKI FIXTURE

[75] Inventor: Egidius Arnold Brangenberg, Garmisch-Partenkirchen, Germany

[73] Assignee: Dieter Thon, Munich, Germany

[22] Filed: Dec. 6, 1974

[21] Appl. No.: 530,490

[30] Foreign Application Priority Data

Dec. 8, 1973 Germany ..... 2361258

[52] U.S. Cl. ..... 280/601; 280/11.37 E

[51] Int. Cl.[2] ..... A63C 5/06

[58] Field of Search ..... 280/11.37 E, 11.13 T, 280/11.35 R; 161/167; 24/201 LP, 230 NP, 230 AV, 248, 134, 170, 191, 68 R

[56] References Cited

UNITED STATES PATENTS

| | | | |
|---|---|---|---|
| 2,611,624 | 9/1952 | Gurvich | 280/11.37 E |
| 3,045,306 | 7/1962 | Taylor | 24/134 R |
| 3,284,091 | 11/1966 | Spier | 280/11,37 E |
| 3,608,158 | 9/1971 | Bengtsson | 24/170 |
| 3,734,816 | 5/1973 | Swasey | 161/167 |
| 3,761,106 | 9/1973 | Schwarz | 280/11.37 E |
| 3,763,858 | 10/1973 | Buese | 161/167 |
| 3,863,944 | 2/1975 | Waddel | 280/11.37 E |
| 3,873,111 | 3/1975 | Imagawa | 280/11.35 R |

*Primary Examiner*—M. H. Wood, Jr.
*Assistant Examiner*—David M. Mitchell
*Attorney, Agent, or Firm*—Cushman, Darby & Cushman

[57] ABSTRACT

A ski fixture for preventing an unintentional crossing of the skis during skiing is described, which fixture is directly secured to the upper surface of the ski by an adhesive in the form of a thin coating which includes a porous resin foam as a carrier material being impregnated with an adhesive solution. Preferably the fixture comprises a base plate to be inseparably mounted on the ski and a bracket removably secured to the base plate by a clamping pin.

11 Claims, 9 Drawing Figures

SKI FIXTURE

BACKGROUND OF THE INVENTION

The invention relates to a ski fixture to be directly secured by an adhesive bond to the upper surface of a ski, preferably at a short distance from the pointed end of the ski, for preventing an unintentional crossing of skis during skiing.

Such a ski fixture is already known. The known ski fixture, however, is not simply and quickly mountable. Beside a number of preparatory arrangements, the work consuming most time in order to glue the fixture on the surface of the ski is involved in preparing an adhesive solution and thereupon applying the adhesive solution to the holes provided therefor in the ski fixture. Then, the curing of the adhesive takes at least further five to eight hours with the ski lying. Thus, due to the complicated and lengthy mounting, the known ski fixture cannot be cheap. Besides, a considerable disadvantage resides in the fact that a poisonous curing agent is used in the preparation of the adhesive and, if handled in an inappropriate way, the curing agent may toxically affect the health of the user.

There are other ski fixtures known. Several of the known ski fixtures have flanges by means of which they are to be screwed onto the ski. It is, however, not possible to use a screw connection, i.e. it is not possible for a screw connection to warrant a sufficient safety, because under heavy stress the screws may burst forth from the thin ski leaf and because the screws may particularly affect the resilient properties of the ski.

Another approach is to dispose a comparatively thick resilient intermediate layer along the edges of the fixture's contact surface facing the upper surface of the ski and to glue the ski fixture onto the ski via said intermediate layer, the latter being a resin foam layer provided with an adhesive on both sides. Within that intermediate layer of about annular form, the ski fixture is, however, to be directly glued onto the ski by means of an adhesive as described above. It has, however, turned out that the resilient intermediate layer does not improve the adhesive effect.

DETAILED DESCRIPTION OF THE INVENTION

Figure 1:
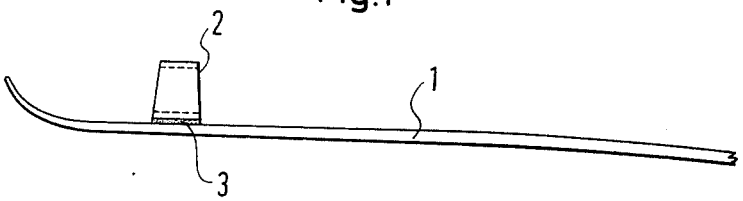

It is an object of the invention to provide a ski fixture which is simply and quickly mountable and which, after being mounted, is sufficiently safely secured to the ski, so that the work and costs involved are less than those required in connection with the ski fixtures hitherto known.

It is a further object of the invention to eliminate the risk of mounting the fixture in the wrong way and thus to save the additional time-consumption and costs caused by a wrong mounting.

The above objects are accomplished according to the invention in a ski fixture of the type mentioned in the beginning, in that the fixture's surface which contacts the ski bears an adhesive in the form of a thin coating which includes a porous resin foam as a carrier material, said resin foam being impregnated with an adhesive solution or emulsion, and in that the lower surface of the coating is covered by a removable protective sheet.

The protective sheet is removed before the ski fixture is secured to the ski, and the thin resin foam layer including the adhesive is self-sticking, so that the ski fixture of the invention can be secured to the ski in a second. Owing to the simple handling, a wrong assembly is virtually impossible. When suitable materials are used, there is obtained an extraordinarily firm adhesive bond which will withstand even the heaviest stress and extreme temperature fluctuations.

The prior art has already disclosed a ski fixture which comprises a base plate to be inseparably mounted on the ski and a bracket removably secured to said base plate including a resilient intermediate layer provided between said two members. Compared with the known one-part ski fixtures, such a two-part ski fixture has the advantage that the bracket, which extends far upwardly, may be removed from the base plate, e.g. to transport the skis in an envelope or in a bag. Another advantage of the two-part ski fixture resides in the fact that the bracket may be alternately used on various skis which must, in that case, just be provided with a corresponding base plate each.

That known two-part ski fixture comprises a lug arranged on the base plate, which lug, when the fixture is used, projects through an opening provided in the lower wall of the bracket and is engaged by a pin, which holds the bracket clamped onto the base plate across the resilient intermediate layer.

In practice it has, however, turned out that the latter ski fixture has various disadvantages impairing the use thereof. Thus, the central clamping by the pin in conjunction with the lug does not warrant that the bracket is sufficiently firmly locked in position on the base plate, so that percussions hitting the bracket may displace the bracket relative to the base plate and, thus, relative to the ski, which, firstly, impairs the good appearance and the efficacy of the ski fixture and, secondly, increases the risk of damaging the bracket by percussions. In particular there is the risk that the comparatively small pin may be unintentionally opened by such percussions and get lost. Further, the damping effect which is expected to be obtained by means of the resilient intermediate layer is eliminated due to the crease which extends across the whole width of the base plate in the direction transverse to the ski and is provided in the base plate for the lug to be hooked therein, because in the area of the crease, the resilient intermediate layer is virtually completely squeezed away when the bracket is clamped on the base plate.

These shortcomings can be definitely avoided in a simple way according to the invention, whereby the base plate includes upwardly extending walls disposed on two opposite sides of the base plate and the lower wall of the bracket is accommodated between said upwardly extending walls in a positive engagement, and each side wall of the base plate has a hole for receiving a clamping pin, which rests on the inner side of the lower wall of the bracket to releasably hold the same.

Not only does the above suggestion remove the shortcomings described above, but the ski fixture according to the invention also is less complicated and therefore cheaper to manufacture since it has one structural member less than the known fixture.

In a further development of the invention, the sides of the base plate on which walls are arranged may extend along a bent line, and so, either along a convex or a concave line. This provides a particularly good positive engagement between the base plate and the bracket.

According to a preferred embodiment of the invention, the base plate is provided with the resilient intermediate layer, so that in the two-part ski fixture one may readily use the same brackets that are also directly glued on the ski surface for ski fixtures which are inseparably mounted on the ski.

Further advantages and developments of the invention will be described below by reference to the drawings, which serve to further illustrate the invention.

Figure 2:
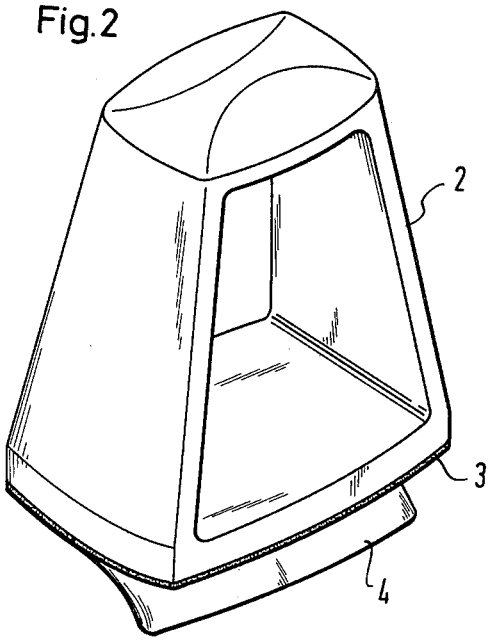
Figure 3:
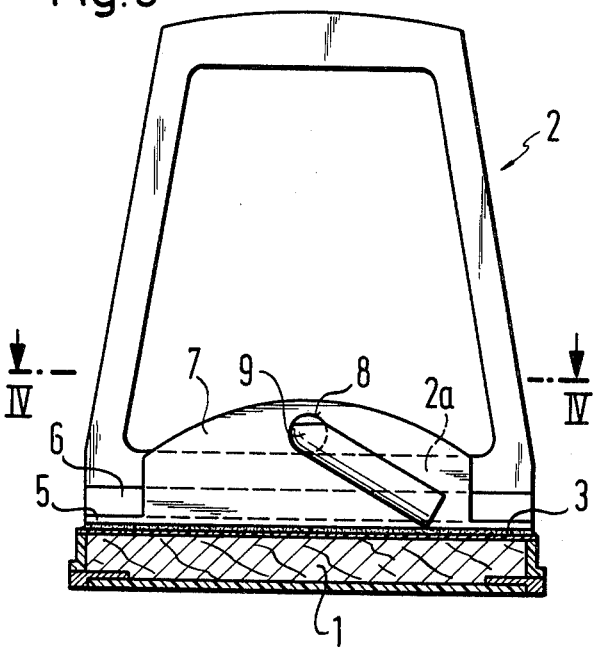
Figure 4:
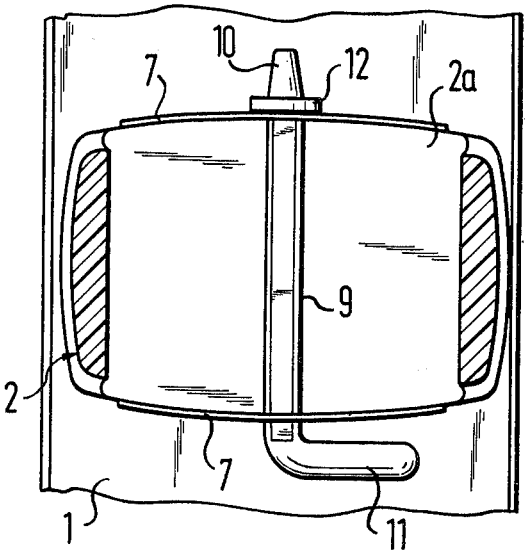
Figure 8:
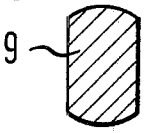
Figure 9:
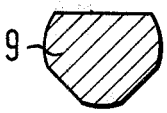

FIG. 1 is a lateral view of a ski including the ski fixture mounted thereon, FIG. 2 shows the ski fixture of FIG. 1 by itself in a perspective view and on a greater scale, FIG. 3 shows a mounted ski fixture according to a second embodiment, seen in the direction longitudinal to the ski, FIG. 4 is a section through the ski fixture according to FIG. 3 along the line IV—IV, and FIGS. 5 to 9 show various possible cross-sectional shapes of the clamping pin on a greater scale.

The ski fixture in the form of a bracket 2 mounted on a ski 1, serves to prevent an unintentional crossing of skis during skiing. It is expedient to arrange the ski fixture in the location shown in FIG. 1, near the pointed end of the ski, and to adapt it to have the shape of a substantially tetragonal piece of pipe of trapezoidal cross-section as is shown in FIG. 2.

The lower surface of said piece of pipe is the contact surface by which the bracket 2 rests on the ski. The lower surface is provided with an adhesive coating 3 which is downwardly covered by a protective sheet 4, the latter being removable before the bracket is mounted on the ski.

The coating includes a porous resin foam strip as carrier material, said resin foam strip being impregnated with the adhesive solution or emulsion. The resin foam strip may consist of polyurethane and be about 0.8 mm or less thick. A thickness of 0.4 mm has proved to be advantageous. The adhesive may be a synthetic one or an inorganic one.

To mount the ski fixture is an extremely simple and tidy action and is accomplished in a short time in that the protective sheet 4 is removed and the bracket 2 is firmly pressed on the suitable location of the ski surface which had been cleaned and wherefrom grease had been removed before.

In the embodiment according to FIGS. 3 and 4, the ski fixture comprises a base plate 5 and a bracket 2 removably secured thereto. The base plate 5 is firmly glued onto the ski 1 by means of the adhesive coating 3 in the same way as described above in connection with the one-part ski fixture. The upper side of the base plate 5 is provided with a resilient intermediate layer 6, which may, for example, be made of foam rubber. The base plate 5 comprises two opposed side walls 7. The lower wall 2*a* of the bracket 2 is accommodated between said side walls in a positive engagement. In the embodiment shown in the drawing, the side walls are convex (FIG. 4), so that the bracket 2 cannot move relative to the base plate 5 either in the longitudinal direction of the ski or transversely thereto.

Each side wall 7 of the base plate 5 has a round hole 8. A clamping pin 9 is inserted through said holes 8. The clamping pin rests on the lower wall 2*a* of the bracket 2 and holds the latter in position under a tension produced by the resilient intermediate layer 6. As is shown in FIGS. 3 and 4, the holes 8 are arranged in the middle of the side walls 7 and are coaxial, so that the clamping pin 9 is located substantially in the middle of the ski and extends in the longitudinal direction thereof.

Figure 5:
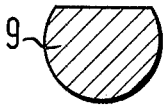
Figure 6:
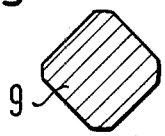
Figure 7:
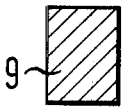

The part of the clamping pin 9 which brings about the clamping effect has, for example, the cross-sectional shape of a circle having a flattened portion, as shown in FIG. 5. FIGS. 3 and 4 show the clamping pin 9 in its clamping position. In this position the flattened portion is at the top. When the clamping pin is rotated through 180° and its flattened portion is at the bottom, it can be pulled out of the holes 8 with virtually no force since in the latter position the resilient intermediate layer 6 is relaxed. In order to facilitate inserting the clamping pin 9 into the holes 8, the end 10 of the clamping pin, by which the pin is inserted, is pointed or tapered. The opposite end of the pin 9 is rectangularly bent and constitutes a handle 11. In order to secure the clamping pin 9 against axial displacement, its end 10 may additionally be provided with a removable retaining ring 12.

The above-described type of mounting the bracket 2, wherein the bracket is secured to the base plate 5, has the benefit of the resilient absorption of percussions, which usually hit the bracket laterally, and so owing to the fact that it is possible for the bracket 2 to swing about the clamping pin 9 against the action of the resilient intermediate layer 6. The stress acting on the bracket 2 as a result of percussions will thus be absorbed by the resilient intermediate layer 6 and will not reach the base plate 5, whereby said base plate or the adhesive layer 3 are prevented from being torn off the ski 1.

FIGS. 6 to 9 show various possible cross-sectional shapes of the clamping pin 9, all of which make use of the principle of the clamping effect of eccentrics, just as the clamping pin 9 of FIG. 5 having the cross-sectional shape of a flattened circle. Like FIG. 5, FIGS. 6 to 9 show the clamping pin 9 in its clamping position each. Before the clamping pin 9 is pulled out of the holes 8 provided in the side walls 7 of the base plate 5, it must be rotated through an appropriate angle of, for example, 45° or 90° or 180°, depending on the geometrical shape of the pin.

What is claimed is:

1. In a ski fixture for preventing unintentional crossing of skis during skiing, to be directly secured to the upper surface of a ski, preferably at a short distance from the pointed end of the ski, the improvement comprising a thin adhesive bond coating on a surface of the fixture to be secured to the upper surface of the ski, a removable protective sheet covering a surface of the coating to be adhered to the upper surface of the ski, a base plate to be inseparably mounted on the ski by said adhesive bond coating and a bracket having a lower wall with a free inner side, said bracket being removably secured to said base plate including a resilient intermediate layer provided between said bracket and said baseplate to to conform with antecedent, wherein the base plate includes upwardly extending side walls disposed on two opposite sides of the base plate, said side walls accommodating said lower wall of the bracket between themselves in a positive engagement, and wherein each said side wall of the base plate has a hole, and a clamping pin extending through said holes and resting on said inner side of said lower wall of the bracket to releasably hold the same.

2. Ski fixture according to claim 1, wherein said walls on the sides of the base plate extend along a bent line.

3. Ski fixture according to claim 1, wherein the holes are provided in the middle of the side walls of the base plate to oppose each other and have a circular cross-section.

4. Ski fixture according to claim 3, wherein the holes are disposed along an axis extending in the longitudinal direction of the ski.

5. Ski fixture according to claim 1, wherein the free end of the clamping pin, by which the pin is inserted, is tapered.

6. Ski fixture according to claim 1, wherein an end of the clamping pin opposite to a free end is bent to form a handle.

7. Ski fixture according to claim 1, wherein the cross-section of the clamping pin has the shape of a circle having a flattened portion, the pin by its rotation compressing the resilient layer by downward movement of the bracket.

8. Ski fixture according to claim 1, wherein the cross-section of the clamping pin is non-circular, the pin by its rotation compressing the resilient layer by downward movement of the bracket.

9. Ski fixture according to claim 1, wherein the resilient intermediate layer is permanently fixed to the base plate.

10. Ski fixture according to claim 1, wherein a removable retaining ring for retaining a free end of the clamping pin is provided, said retaining ring abutting against the outside of one of the upwardly extending walls of the base plate.

11. In a ski fixture according to claim 1, said adhesive bond coating including a porus resin foam of polyurethane as a carrier material which is at most about 0.8 mm thick, the resin foam being impregnated with an adhesive solution or emulsion.

* * * * *